United States Patent [19]

Matej

[11] Patent Number: 4,475,371

[45] Date of Patent: Oct. 9, 1984

[54] TESTING AND STRAIGHTENING MACHINE

[75] Inventor: Ronald J. Matej, Parma Heights, Ohio

[73] Assignee: Litton Industrial Products, Inc., Cleveland, Ohio

[21] Appl. No.: 496,517

[22] Filed: May 20, 1983

[51] Int. Cl.[3] ..... B21D 3/16

[52] U.S. Cl. ..... 72/68; 72/92

[58] Field of Search ..... 72/67, 68, 88, 90, 92, 72/93, 94

[56] References Cited

U.S. PATENT DOCUMENTS 3,930,392 1/1976 Matej ..... 72/92

4,037,447 7/1977 Sampson et al. ..... 72/92

FOREIGN PATENT DOCUMENTS 57-72743 5/1982 Japan ..... 72/92

*Primary Examiner*—Lowell A. Larson

*Attorney, Agent, or Firm*—Louis V. Granger

[57] ABSTRACT

A machine is disclosed which will test an elongated round cross-section workpiece by bending the workpiece as it is rotated to determine if a breakable area such as a welded area will break. Broken workpieces are discarded but those testing satisfactorily proceed through the machine for a straightening operation to straighten the entire workpiece, including the breakable area. The above description is merely one form of the invention and is not to be construed as limiting on the scope of the invention.

17 Claims, 10 Drawing Figures

TESTING AND STRAIGHTENING MACHINE

BACKGROUND OF THE INVENTION

U.S. Pat. No. 3,930,392 illustrated a machine to straighten a flanged stemmed workpiece such as a poppet valve. This utilized a rotary machine to deflect the flanged head and straighten the stem. More recently a need has arisen to not only straighten elongated workpieces which have a round cross-section, such as poppet valves, but also to test them to test a welded area between the head and the stem. This welded area is breakable if the weld is imperfect. A previously used method to test the welded poppet valves was to chuck each one individually in a lathe, rotate the workpiece and then deflect the valve head by pressure near the head to see if the welded joint would break. The bent workpiece was then unchucked and placed in a separate straightening machine to straighten the stem and bent head of the poppet valve.

U.S. Pat. No. 4,037,447 illustrates a straightening machine operating on the planetary principle and is used to straighten elongated workpieces which have a round cross-section.

The difficulty with the aforementioned patented structures is that they perform only a straightening operation. The difficulty with the testing of the welded poppet valves was that it required two separate machining set-ups and separate feeding to two different machines to effect, first, the testing of the weld joint and, secondly, the straightening of the bent workpiece.

Accordingly, the problem to be solved is how to construct a more efficient testing and straightening machine which combines into one machine both the testing function and the subsequent straightening function.

SUMMARY OF THE INVENTION

This problem is solved by a combination testing and straightening machine for elongated round cross-section workpieces having a breakable area therein, comprising, in combination: a base; straightening means; testing means; feed means; and movement means on said base; said straightening means including an arcuate first dieholder fixed on said base, a rotary second dieholder journalled on said base on a first axis, said first dieholder adapted to adjustably hold an arcuate first fixed die having an entrance end and an exit end, said second dieholder adapted to hold a rotatable second die; said feed means adapted to feed workpieces to the entrance end of the first fixed die; said movement means including drive of said rotary second dieholder for rotary passage of such workpieces nominally in a first path of movement between the first and second dies in accordance with rotation of said second dieholder; said straightening means increasingly bending the workpieces until about the mid-point of the rotary passage and then decreasingly bending such workpieces as they approach the exit end of the first fixed die for the straightening of such workpieces; said testing means including deflecting means operative on the workpieces near the breakable area thereof for only a short portion of said rotary passage near the first die entrance end, said deflecting means including the holding of the workpieces by said dies and the rotary passage of the workpieces between the dies, said deflecting means establishing a second path intersecting said first path in a first radial direction and then in a second opposite radial direction to engage and cyclically deflect the workpieces an amount sufficient to impart a bending stress thereto which will exceed the breaking point of defective breakable areas yet not exceed the breaking point of satisfactory breakable areas, and said movement means including the rotation of said rotary dieholder to establish rotary passage of the workpieces prior to and subsequent to said testing by said testing means.

The problem is further solved by a testing apparatus in a straightening machine for headed stemmed workpieces having a breakable area in the stem, said straightening machine including straightening means, feed means, and movement means on a base; said straightening means including said feed means adapted to feed workpieces to an entrance end of a first fixed die, said movement means including drive of a rotary second dieholder for rotary passage of stems of such workpieces nominally in a first path of movement between said first and second dies in accordance with rotation of said second die for progressive bending and straightening of such stems as the workpieces approach the exit end of said first fixed die; characterized in that said testing apparatus includes deflecting means operative on the workpiece near the heads thereof for only a short portion of said rotary passage near said first die entrance end, said deflecting means establishing a second path intersecting said first path in a first direction and then in a second opposite direction to engage and cyclically deflect the workpiece stems an amount sufficient to impart a bending stress which will exceed the breaking point of defective breakable areas yet not exceed the breaking point of satisfactory breakable areas.

The problem is further solved by a testing and straightening machine for elongated round cross-section workpieces having a breakable area therein, comprising, in combination: a base; a rotatable dieholder journalled on said base for rotation about an axis; a fixed dieholder on said base adapted to adjustably hold at least first and second axially spaced fixed dies; said rotatable dieholder adapted to adjustably hold at least first and second axially spaced rotatable dies adapted to cooperate with said fixed dies to engage and frictionally drive the successive workpieces therebetween; breaking means adapted to bend defective workpieces to the point of breaking, said breaking means including a rotatable deflection die journalled substantially about said axis; a rotatable deflecting die connected for rotation in accordance with rotation of said rotatable dieholder; a fixed deflecting die fixed on said fixed dieholder and generally arcuately spaced from said rotatable deflection die for receiving a workpiece therebetween; means to rotate said rotatable dieholder for effecting passage of workpieces in the space between said rotatable and fixed dieholders for effecting straightening of the workpieces; an arcuate portion protruding on one of said deflecting dies and an arcuately recessed portion at the entrance area of the other of said deflecting dies to deflect said workpieces by said protruding portion to an extent sufficient to stress said workpieces at a breakable area therein to about 33,000 psi in bending stress for at least two full revolutions of each such workpiece, to cause breakage of defective workpieces; and said workpieces being straightened by said first and second rotatable and fixed dies and by said deflecting dies subsequent to said breakable area testing.

Accordingly, an object of the invention is to provide a combined machine which has a planetary action and bends a workpiece to test it and then subsequently deflects the workpiece to straighten it.

Another object of the invention is to provide a machine which not only tests but separates satisfactory from unsatisfactory workpieces.

Other objects and a fuller understanding of this invention may be had by referring to the following description and claims, taken in conjunction with the accompanying drawings.

DESCRIPTION OF THE PREFERRED EMBODIMENTS

Figure 1:
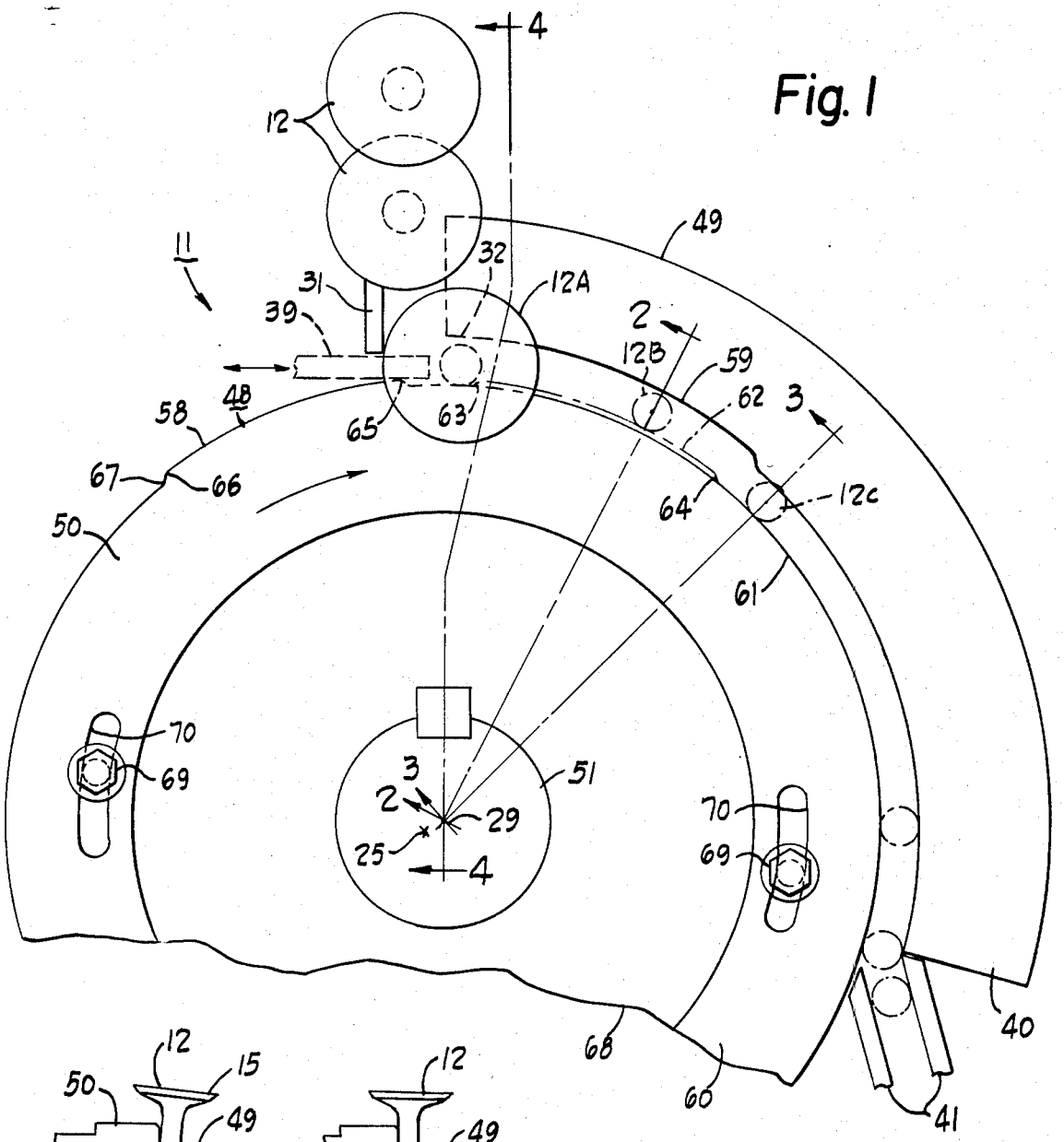
FIG. 1 is a partial plan view of a combined testing and straightening machine according to the invention.
Figure 4:
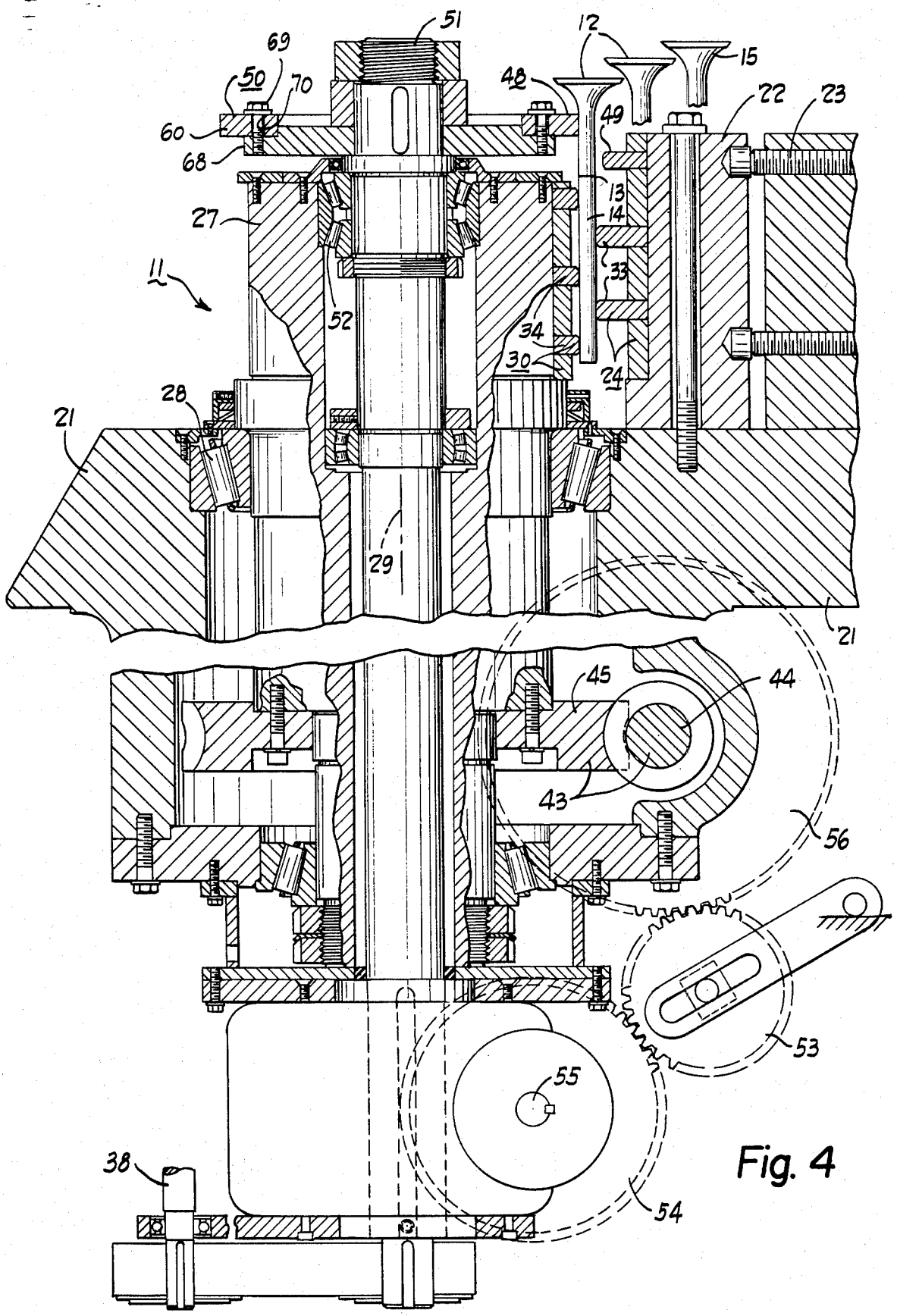
FIG. 4 is a longitudinal sectional view on line 4—4 at a reduced scale of the machine of FIG. 1.
Figure 8:
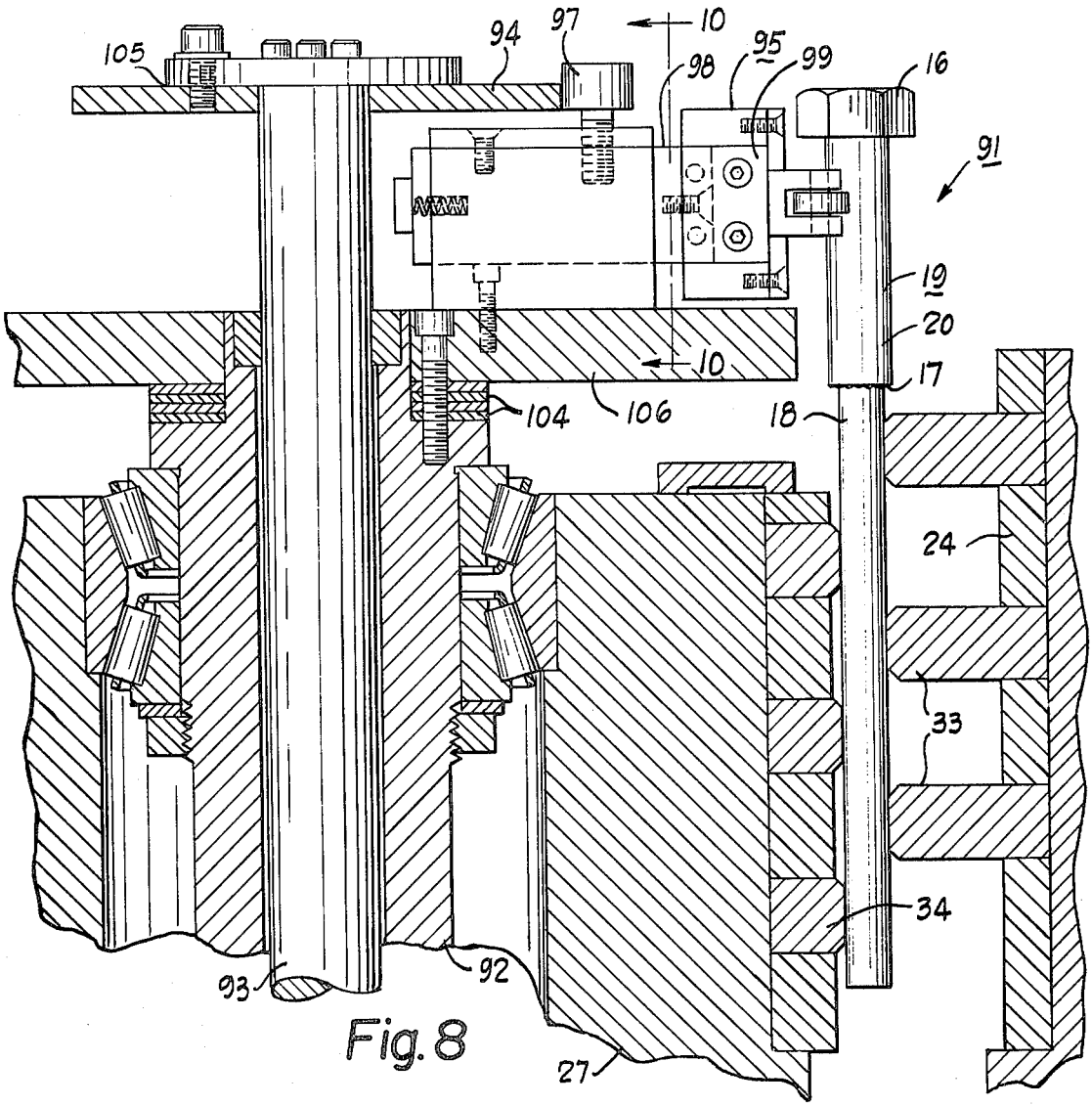
FIG. 8 is a partial sectional elevational view of the machine of FIG. 7.

FIGS. 1 and 4 illustrate a testing and straightening machine 11 which may be used to both test and straighten successive workpieces 12. These workpieces are elongated and have round cross-sections. Examples of such workpieces may be poppet valves or headed bolts, as shown in FIG. 8. The testing of the workpieces is for some breakable area 13 in the stem 14 of the workpieces. An example of a breakable area is a butt-welded joint between a high alloy head 15 and a common steel stem 14. Another example is a mine roof bolt 19 shown in FIG. 8 where an alloy head 16 is welded at 17 to an elongated stem 18 which later will be threaded to receive a nut.

The machine 11 in FIGS. 1 and 4 includes a frame 21 which carries a first fixed dieholder 22. This dieholder is adjustable by usual means such as the machine screws 23. A first die 24 is a segment adjustably mounted on the first dieholder 22 and is curved in a circular arc about a first axis 25. A second dieholder 27 is rotatable on the frame 21 being journalled by means of bearings 28. This second dieholder is journalled about a second axis 29. The first axis 25 is parallel to but displaced from the second axis 29. The second dieholder 27 is adapted to mount a second rotatable die 30. The successive workpieces 12 may be fed down a chute 31 to enter at the entrance end 32 of the first die 24 and then are adapted to have a rotary passage between the dies 24 and 30 in accordance with rotation of the die 30. This may be a rotary passage established by small rollers on the rotatable die engaging each individual workpiece so that the workpiece has a circumferential speed equal to the circumferential speed of the rotatable die 30. However, as shown, the rotary passage is a planetary passage between the two dies. This is effected by a plurality of die segments 33 as a part of the first die 24, and a plurality of circular die rings 34 as part of the second rotatable die 30. The die segments 33 and die rings 34 constitute straightening means to straighten the stems 14 or 18 of the workpieces.

Feed means 38 is a cam shaft provided in the machine 11 to feed successive workpieces to the entrance end 32 of the fixed die 24. This may include a feed finger 39 synchronized in a usual manner with the rotation of the rotatable die 30 to feed workpieces from the chute into the entrance end 32. The workpieces have rotary passage between the two dies to the exit end 40 of the fixed die 24 whereat a fork 41 catches straightened workpieces as they exit from the machine 11.

Movement means 43 is provided on the machine 11 and includes a motor, not shown, driving a shaft 44 which acts through a worm gear and a worm wheel 45 to rotate the second dieholder 27. This movement means 43 establishes movement of the workpieces 12 and 19 through the machine either by rotary passage or by planetary passage of such workpieces, and includes the frictional drive between the die segments 33, die rings 34 and the workpieces.

Testing means 48 is provided in the machine 11 and this testing means includes first and second deflecting means 49 and 50 respectively. In the embodiment of FIG. 1 the first deflecting means 49 is an arcuate segment fixed on the first fixed dieholder 22. The second deflecting means 50 is a deflecting die ring fixed to rotate with an inner shaft 51 journalled at 52 inside the second dieholder 27. This inner shaft 51 is driven from the shaft 44 by means of gear 56, the idler gear 53 and a gear 54 driving a worm shaft 55 and a worm wheel, not shown, connected to the inner shaft 51. In this manner, the two shafts 51 and 27 are geared together for concurrent rotation. A chain and sprocket may be used to replace the gear 56 on shaft 44 and the gear 54 on shaft 55, the important aspect being the correlation of the two shaft speeds.

As better shown in FIG. 1 the first and second deflecting means 49 and 50 co-act to bend the heads of the workpieces 12 to test the weld or breakable area 13 to determine if it will break at that point. Either the first or the second deflecting means 49 or 50 includes a projection to engage and deflect the workkpiece. In the embodiment of FIG. 1 this projection 58 is a radially outwardly extending projection on a ring 60 on the second deflecting means 50 which is the rotatable die ring. Ring 60 is attached to a support disc 68 by screws 69 passing through adjusting slots 70 for the purpose of timing. The projection 58 is shown unitary with the ring 60, but it may be a separate insert. A corresponding arcuate cut-away portion 59 is provided on the first deflecting means 49 to permit the bending deflection of the workpieces 12. The deflecting means 49 and 50 includes the holding of the workpiece 12 by the dies 24 and 30 and includes the rotary passage of the workpiece stems between the dies. The rotary passage of the workpiece stems is illustrated in FIG. 1 as occurring along a first path 61 which is established by the contact surface of the rotatable die rings 34. The deflecting means 49, 50 establishes a second path 62 which intersects the first path 61 in a first radially outward direction at about a point 63 near the entrance end 32 of the first die 24 and then intersects this first path 61 in a second radially inward direction at about a point 64. The first radially intersecting point 63 is caused by a cam rise 65 between the arcuate cylindrical surface 67 of the second deflecting means 50 and the projection 58. The second intersecting point 64 is caused by the cam drop-off 66 between the projections 58 and the arcuate cylindrical surface 67.

OPERATION

Figure 2:
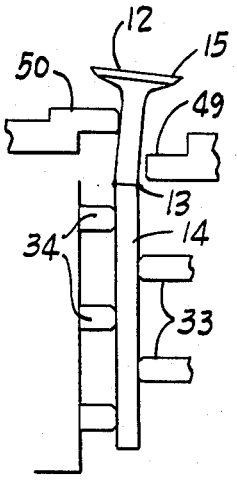
FIG. 2 is a partial sectional view on the line 2—2 of FIG. 1, to a reduced scale.
Figure 3:
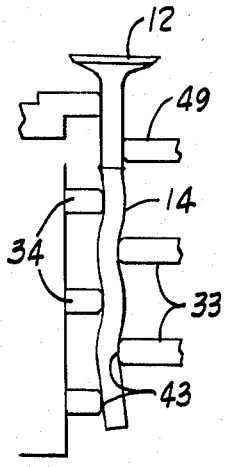
FIG. 3 is a partial sectional view on the line 3—3 of FIG. 1, to a reduced scale.

FIG. 1 illustrates a workpiece 12A which has just entered the entrance end 32 of the first die 24. FIG. 4 is a section taken through the machine at this point and the workpiece 12A is gripped between the die segments 33 and the die rings 34 for rotary passage through the machine. In this case this is a planetary passage. Because of the cut-away portion 59, the first deflecting means 49 does not engage the workpiece. FIG. 2 is a section taken on the line 2—2 of FIG. 1 and shows the workpiece in a position 12B as deflected by the projection 58. The cut-away portion 59 is still out of contact at this point. FIG. 3 shows the workpiece in a position 12C where the testing is completed and the workpiece has passed the cut-away portion 59, also the projection 58 has rotated clockwise beyond the workpiece 12C. The testing is a controlled bending of the workpiece stem near the head 15 to determine if the workpiece will break at the breakable area 13. This may be a weld area where a high alloy head is welded to a common steel stem 14. In one machine constructed in accordance with the invention poppet valves were being tested which were about one-half inch in diameter and about eight inches long. The deflection of the valve head was to be an amount of 0.020 inches at a distance of two and one-half inches above the weld area. This was sufficient to place a 33,000 psi stress on the weld by this deflection, as one example only. At least three complete revolutions of the workpiece is achieved by the machine 11 during this breakable area testing. If the valve has a defective weld it will not withstand this stress and the head will break off at the weld. It will merely roll around and fall off the machine and the broken stem will fall out of the machine into a catch box at the exit end 40 of the first die 24. If the workpiece passes the test then it is subsequently straightened and caught in the fork 41 to be passed to a box of tested and straightened workpieces.

The straightening subsequent to the testing is achieved not only by the die segments 33 and die ring 34 but also by the first and second deflecting means 49 and 50. FIG. 3 shows the workpiece 14 at about the midpoint of its travel through the arcuate first die 24. This die 24 might be a segment of 100 to 120 degrees, as an example, and will provide at least a dozen rotations of the workpiece for straightening. Due to the first axis 25 being displaced from the rotational axis 29, the workpiece stems 14 are bent into a serpentine shape to a maximum extent at about the midpoint of the first die 24. This is because a line joining the axes 25 and 29 will intersect the midpoint of the first die 24. After the midpoint of the first die 24 is passed the serpentine deflection of the workpiece 12 gradually decreases until the exit end 40 is reached whereat the workpieces have been straightened.

SECOND EMBODIMENT

Figure 5:
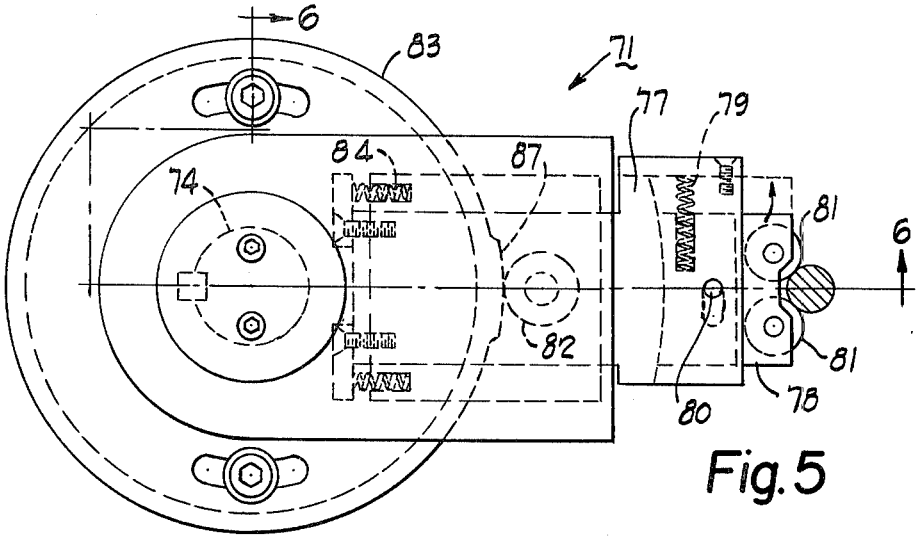
FIG. 5 is a partial plan view of a modification.
Figure 6:
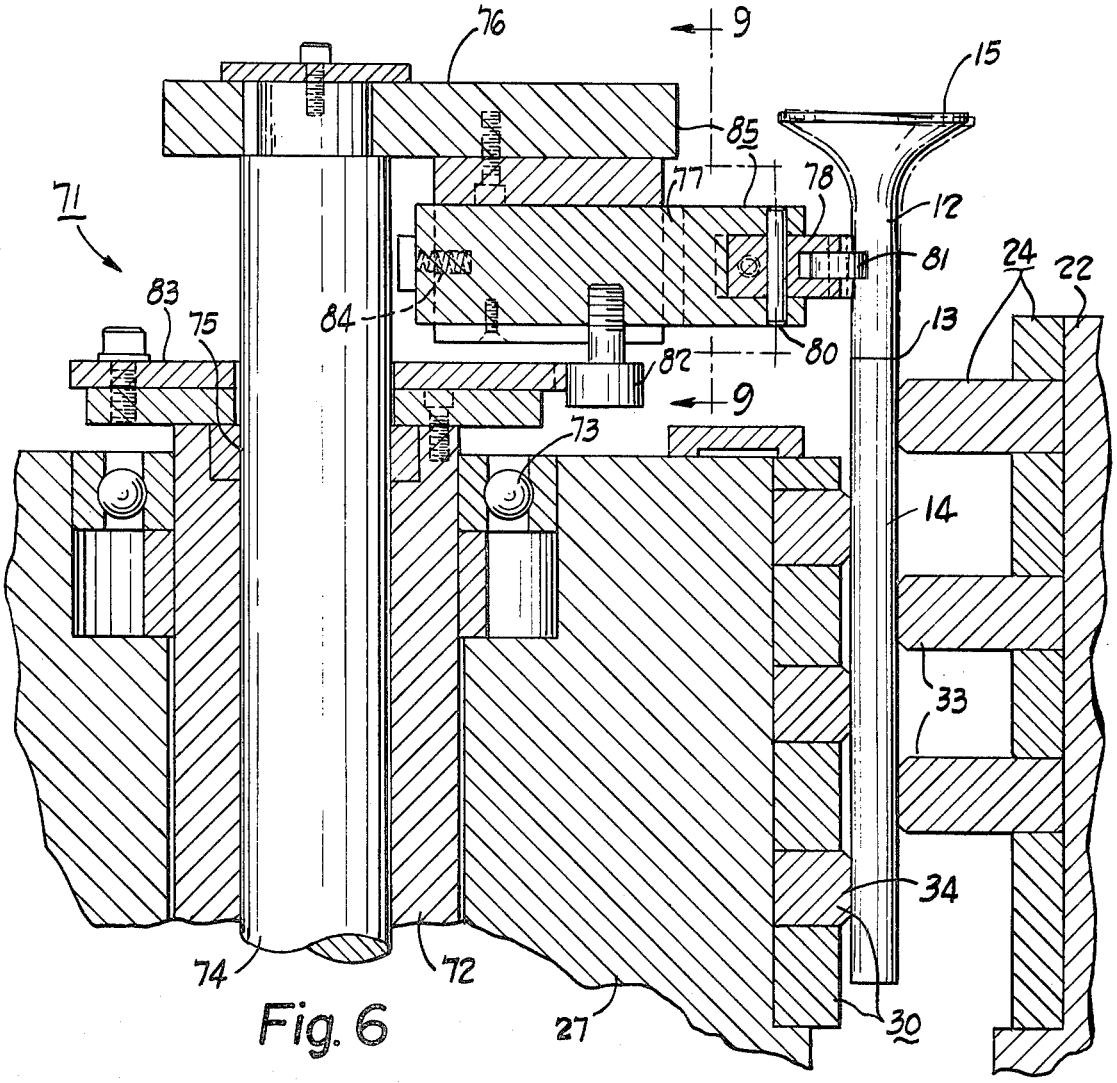
FIG. 6 is a partial elevational sectional view of the machine of FIG. 5.
Figure 9:
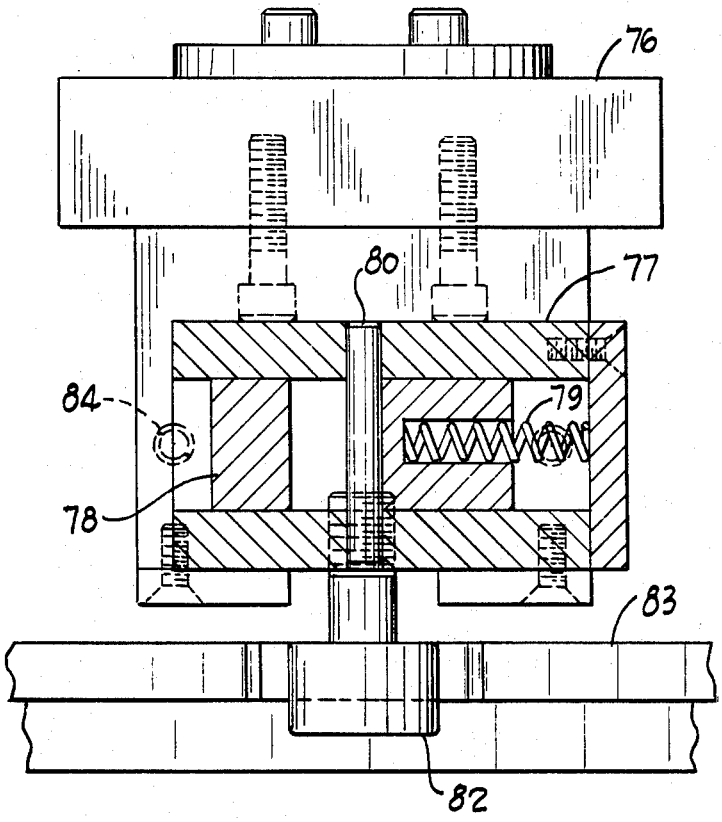
FIG. 9 is an enlarged sectional view on line 9—9 of FIG. 6.

FIGS. 5, 6 and 9 illustrate a second embodiment of a combined testing and straightening machine 71 for testing workpieces 12. In this embodiment only the upper part of the machine is shown including a part of the first die 24 and the first dieholder 22. A part of the second dieholder 27 is shown carrying the die rings 34 to co-act with the die segments 33 for rotary passage of the workpieces 12 between the rotatable and fixed dies. The frame, not shown, carries a fixed extension 72 which has bearings 73 to journal the rotatable second dieholder 27. An inner shaft 74 is journalled by the bearings 75 and carries a deflecting means 76 as part of a testing means 85. This deflecting means 76 is an arm rotatable with the shaft 74 and carrying a radial slide 77 and an arcuately movable slide 78. The slide 78 is urged by a spring 79 in a clockwise direction as determined by a limit pin 80. The slide 78 carries rollers 81 to straddle and engage the upper stem area 15 of the workpiece 12. The slide 77 carries a cam follower 82 which follows a cam 83 which is fixed on the extension 72. Springs 84 urge the cam follower 82 inwardly against the cam 83.

The feeding means, straightening means and movement means for the machine 71 of FIGS. 5, 6 and 9 may be essentially the same as for the machine 11 of FIG. 1. The testing means includes the deflecting means 76 as well as its passage through the machine. The cam 83 has a projection 87 to force the cam follower 82 outwardly and, thus, force the workpiece head outwardly to stress it as it is rotated. This projection 87 has an arcuate extent sufficient to permit the workpiece to have at least two or three full revolutions while being deflected for testing the breakable area 13. The inner shaft 74 is positively connected for rotation in accordance with the rotation of the second dieholder 27. In one machine constructed in accordance with the invention, the rotatable die rings 34 had a diameter of 14.25 inches to operate on a workpiece diameter of 0.50 inches.

The relative speeds are determined by using the formula for planetary gearing found in the Machinery Handbook of $D=1+C/A$, where D is the rotation of the driver per revolutions of the follower, C is the diameter of the fixed gear, and A is the diameter of the driving gear. In this case the driving gear is the rotatable die rings 34 and A is the diameter of the arcuate die segments 33. The formular is then $D=1+15.25/14.25=2.07$. The speed F of the follower relative to the speed of the driver is then 0.483. As a practical matter, gearing the inner shaft 74 to be half the speed of the rotatable die 27 is approximately correct. The follower or workpiece 12, in its planetary passage will traverse through the machine at a speed 48.3% of that of the rotatable die 27. As an example, if the die 27 rotates at 100 rpm, the workpiece will travel through the machine at 48.3 rpm. With the shaft 74 geared at 50 rpm, it will be seen that it moves slightly ahead of the workpiece 12, and the slide 78 moves rearwardly slightly as permitted by the spring 79 during this arcuate passage through the machine. If the fixed die segment 24 is 120 degrees, then the slide 78 will have to move back about 4.1 degrees during this rotary passage of the workpiece. Such small movement is accommodated by the movement of the slide 78. If the inner shaft is geared at 48 or 49 percent of the speed of the rotatable die 27, then the slight rearward movement will be even less.

The deflecting means 76 tests the weld or breakable area 13 in a manner similar to that of the machine 11 and after the testing the entire workpiece is straightened by the straightening means 33, 34.

Figure 7:
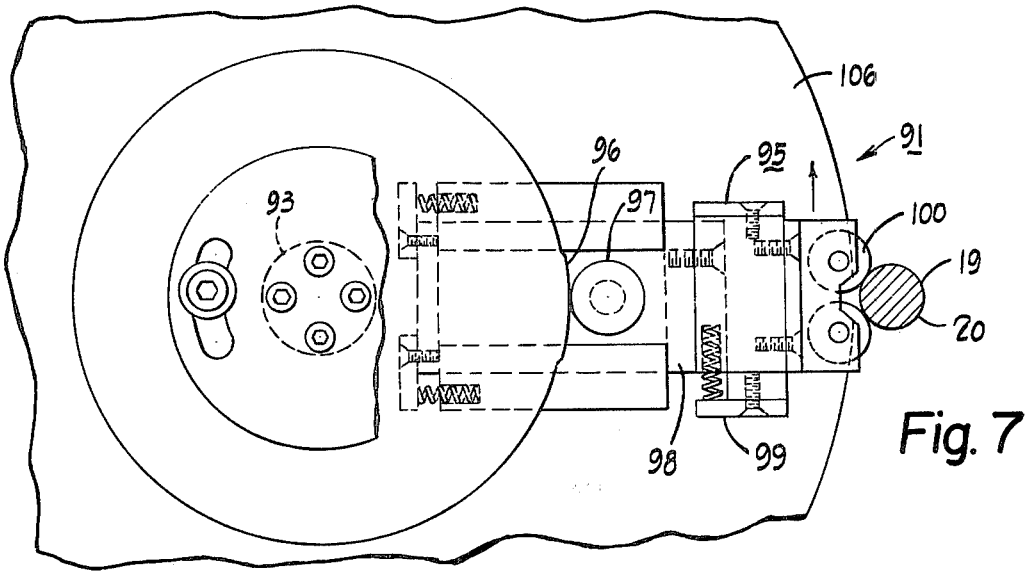
FIG. 7 is a partial plan view of a further modification.
Figure 10:
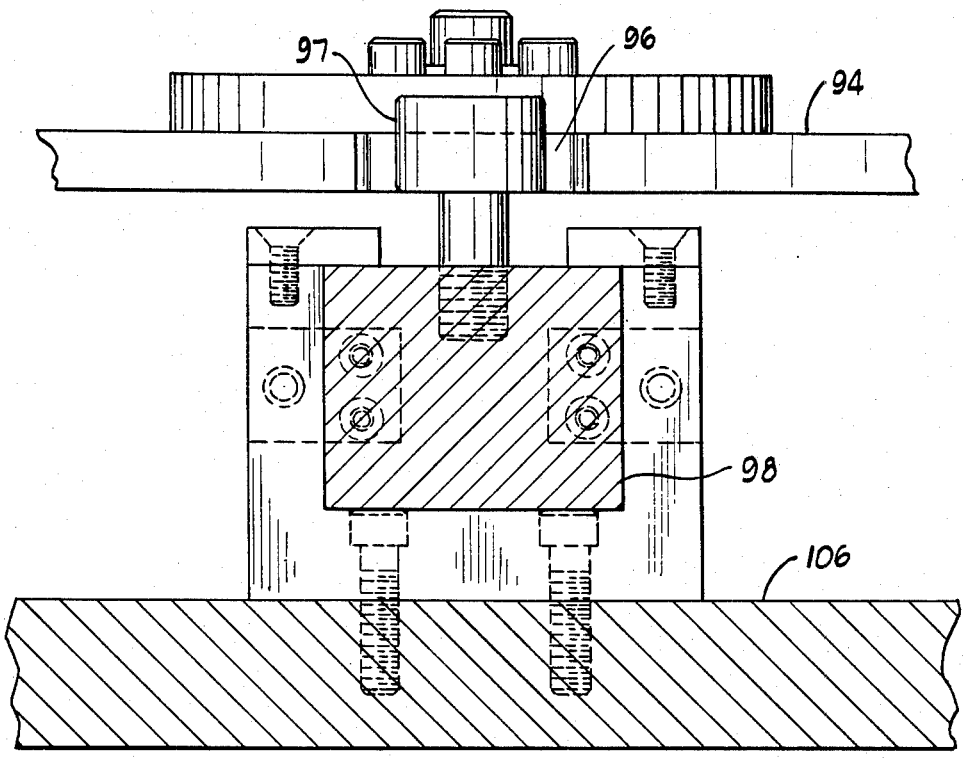
FIG. 10 is an enlarged sectional view on line 10—10 of FIG. 8.

FIGS. 7, 8 and 10 illustrate a third embodiment of a testing and straightening machine 91. Again the feeding, straightening and movement means may be essentially the same as in the machine 11 and the description thereof need not be repeated. The machine 91 has the rotatable dieholder 27, a rotatable inner shaft 92, and a central fixed shaft 93. Again this shaft 92 is geared preferably at about half speed of the rotatable die 27. Deflecting means 94 is provided as a part of a testing means 95 in this machine 91. FIG. 8 illustrates a different form of workpiece 19 to illustrate the versatility of the machine. This workpiece 19 may be a mine roof bolt with an alloy head 16 welded to an elongated stem 18. The weld area 17 is shown between the smaller diameter stem 18 and the enlarged shank 20 again to show the versatility of the machine. The testing means 95 includes the deflecting means 94 and the movement means to move the workpieces 19 through the machine. This again will include the fixed die segments 33 and the rotatable die rings 34. The deflecting means 94 includes a fixed cam with an arcuate projection 96. The cam 94 acts on a cam follower 97 carried in a radially movable slide 98. This slide carries a tangentially movable slide 99 which carries rollers 100 to straddle and engage the workpiece shank 20. Spacers 104 may be removed and replaced at the area 105 immediately above the fixed cam 94 in case it is desired to lower the plate 106 on which the slides 98 and 99 are carried. This plate 106 is mounted on the rotatable inner shaft 92.

In operation, the testing is again carried out first and then subsequently the workpieces 19 are straightened. The testing is done by the projection 96 which forces the cam follower 97 outwardly and deflects the workpiece head 16 so as to stress the weld 17. If the part breaks at the weld the head 16 rolls off the machine and the stem 18 falls out of the machine after straightening. If the workpiece tests satisfactorily it is then straightened and caught by a fork similar to fork 41 shown in FIG. 1, to separate the good from the failed workpieces.

Preferably, the rotational speed of the deflecting means 50 in FIG. 1 is coordinated with the peripheral speed of the workpiece 12 at the line of contact. The gears 54 and 56 are change gears for this purpose. Since the workpiece 12 shown in FIGS. 1 to 4 has a constant diameter along its stem, the speed of the shaft 51 is preferably geared to be the same as the speed of the rotatable die 27. It has been observed, however, that if the speed at the contact surface of die 50 differs from the surface speed of the workpiece 12, the testing and straightening is still accomplished. The die 50 will merely skid forwardly or backwardly on the workpiece, because the workpiece is securely held and driven by the rotatable die rings 34, in conjunction with the die segments 33.

In FIGS. 7 and 8 the workpiece 19 is shown with an enlarged shank 20 which is in contact with the deflecting rollers 100. If this shank is ten percent larger than the stem 18, then the surface speed thereof will be ten percent higher and this is accommodated by the rollers 100. If this type of workpiece is being straightened in the machine of FIGS. 1 to 4, then this enlarged shank will merely skid slightly on the deflecting die 50, which will have a slightly reduced diameter to accommodate the larger shank 20. Alternatively, the cam deflecting means 50 can be geared to have a ten percent higher speed than the speed of the rotatable dieholder 27, so that the surface speed thereof will match that of the enlarged shank 20.

In FIGS. 6 to 10 no deflecting die segment similar to the first deflecting means 49 is shown above the weld 13. Such a deflecting means can be provided above the weld just as shown in FIGS. 1 to 4.

The testing and straightening machine 11, 71 and 91 establish the testing first and the straightening second. However, by close observance of FIG. 1, for example, it will be noted that some straightening of the stem does begin to occur prior to the completion of the testing. This adds to the speed of operation of the machines.

In FIG. 5, the arcuately movable slide 78 accurately reproduced the desired cam follower movement. In FIG. 7, the tangentially movable slide 99 does not quite accurately reproduce the desired cam follower movement as the slide drops back slightly. This can be accommodated by modification of the shape of the cam projection 96. The linearly moving slide 99 is easier and more economical than the arcuate slide 78.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A combination testing and straightening machine for elongated round cross-section workpieces having a breakable area therein, comprising, in combination:

a base;

straightening means; testing means; feed means; and movement means on said base;

said straightening means including an arcuate first dieholder fixed on said base;

a rotary second die holder journalled on said base on a first axis;

said first dieholder adapted to adjustably hold an arcuate first fixed die having an entrance end and an exit end;

said second dieholder adapted to hold a rotatable second die;

said feed means adapted to feed workpieces to the entrance end of the first fixed die;

said movement means including drive of said rotary second dieholder for rotary passage of such workpieces nominally in a first path of movement between first and second dies in accordance with rotation of said second dieholder;

said straightening means increasingly bending the workpieces until about the mid-point of the rotary passage and then decreasingly bending such workpieces as they approach the exit end of the first fixed die for the straightening of such workpieces;

said testing means including deflecting means operative on the workpieces near the breakable area thereof for only a short portion of said rotary passage near the first die entrance end, said deflecting means including the holding of the workpieces by said dies and the rotary passage of the workpieces between the dies, said deflecting means establishing a second path intersecting said first path in a first radial direction and then in a second opposite radial direction to engage and cyclically deflect the workpieces an amount sufficient to impart a bending stress thereto which will exceed the breaking point of defective breakable areas yet not exceed the breaking point of satisfactory breakable areas;

and said movement means including the rotation of said rotary dieholder to establish rotary passage of the workpieces prior to and subsequent to said testing by said testing means.

2. A combination machine as set forth in claim 1, wherein said deflecting means is mounted on one of said first and second dieholders.

3. A combination machine as set forth in claim 1, wherein said deflecting means is mounted for rotation substantially about said first axis.

4. A combination machine as set forth in claim 1, wherein said deflecting means is an arcuate projection on one of said first and second dies.

5. A combination machine as set forth in claim 4, wherein said arcuate projection has an arcuate extent less than that of said first fixed die.

6. A combination machine as set forth in claim 1, wherein said deflection means is cam operated.

7. A combination machine as set forth in claim 1, wherein said deflection means includes a movable member having a plurality of rollers to engage and deflect the workpiece stem.

8. A combination machine as set forth in claim 1, wherein said deflecting means includes fixed cam with an arcuate projection.

9. A combination machine as set forth in claim 1, wherein said deflecting means includes an arcuately movable slide.

10. A combination machine as set forth in claim 1, wherein said deflecting means includes a tangentially movable slide.

11. A testing apparatus in a straightening machine for headed stemmed workpieces having a breakable area in the stem, said straightening machine including straightening means, feed means, and movement means on a base; said straightening means including said feed means adapted to feed workpieces to an entrance end of a first fixed die, said movement means including drive of a rotary second dieholder for rotary passage of stems of such workpieces nominally in a first path of movement between said first and second dies in accordance with rotation of said second die for progressive bending and straightening of such stems as the workpieces approach the exit end of said first fixed die;

characterized in that said testing apparatus includes deflecting means operative on the workpiece near the heads thereof for only a short portion of said rotary passage near said first die entrance end;

said deflecting means establishing a second path intersecting said first path in a first direction and then in a second opposite direction to engage and cyclically deflect the workpiece stems an amount sufficient to impart a bending stress which will exceed the breaking point of defective breakable areas yet not exceed the breaking point of satisfactory breakable areas.

12. A testing apparatus as set forth in claim 11, including positive drive means to correlate the speed of rotation of said rotary second dieholder with the speed of rotation of said deflecting means.

13. A testing apparatus as set forth in claim 11, including positive drive means to drive said deflecting means at a speed of rotation less than that of said rotary second dieholder.

14. A testing apparatus as set forth in claim 13, wherein said deflecting means is driven at a speed approximately half that of said rotary second dieholder.

15. A testing apparatus as set forth in claim 11, wherein said deflecting means has an effective radius less than that of said straightening means to operate on a portion of the workpiece of a diameter larger than that operated on by said deflecting means.

16. A testing and straightening machine for elongated round cross-section pieces having a breakable area therein comprising, in combination:

a base;

a rotatable die holder journalled on said base for rotation about an axis;

a fixed dieholder on said base adapted to adjustably hold at least first and second axially spaced fixed dies;

said rotatable dieholder adapted to adjustably hold at least first and second axially spaced rotatable dies adapted to cooperate with said fixed dies to engage and frictionally drive the successive workpieces therebetween;

breaking means adapted to bend defective workpieces to the point of breaking, said breaking means including a rotatable deflection die journalled substantially about said axis;

a rotatable deflecting die connected for rotation in accordance with rotation of said rotatable dieholder;

a fixed deflecting die fixed on said fixed dieholder and generally arcuately spaced from said rotatable deflection die for receiving a workpiece therebetween;

means to rotate said rotatable dieholder for effecting passage of workpieces in the space between said rotatable and fixed dieholders for effecting straightening of the workpieces;

an arcuate portion protruding on one of said deflecting dies and an arcuately recessed portion at the entrance area of the other of said deflecting dies to deflect said workpieces by said protruding portion to an extent sufficient to stress said workpieces at a breakable area therein to about 33,000 psi in bending stress for at least two full revolutions of each such workpiece, to cause breakage of defective workpieces; and said workpieces being straightened by said first and second rotatable and fixed dies and by said deflecting dies subsequent to said breakable area testing.

17. A testing and straightening machine as set forth in claim 16, wherein said workpieces have heads at the upper end thereof; and means to receive the heads of satisfactorily tested and straightened workpieces at the exit end of said fixed dieholder to thus automatically discard the straightened stems of broken workpieces.

* * * * *